United States Patent [19]

Wolf

[11] Patent Number: 4,757,580

[45] Date of Patent: Jul. 19, 1988

[54] PEEK-IN STORY BOOK

[76] Inventor: Tobin Wolf, 285 Aycrigg Ave., Passaic, N.J. 07006

[21] Appl. No.: 782,174

[22] Filed: Sep. 30, 1985

Related U.S. Application Data

[63] Continuation of Ser. No. 537,660, Sep. 30, 1983, abandoned.

[51] Int. Cl.[4] ..... B42D 1/00

[52] U.S. Cl. ..... 281/15 R; 281/29

[58] Field of Search ..... 446/147, 148, 149, 150, 446/151, 152, 219; 281/1, 15 R, 29; 283/63 R; 434/331, 121; 40/361, 362, 363, 364, 365, 366, 367, 158 R; 350/143, 135, 133, 140

[56] References Cited

U.S. PATENT DOCUMENTS

| | | | |
|---|---|---|---|
| 956,230 | 4/1910 | Thompson | 281/1 X |
| 1,237,940 | 8/1917 | Morrison | 446/147 X |
| 2,548,043 | 4/1951 | Muhlhauser | 283/63 R |
| 2,553,160 | 5/1951 | Arps | 40/367 X |
| 2,683,391 | 7/1954 | Nichols | 283/63 R X |
| 2,874,707 | 2/1959 | Koppel | 283/63 R X |
| 3,191,319 | 6/1965 | Waisgerber | 283/63 R X |
| 3,488,872 | 1/1970 | Levy, Jr. | 40/365 |
| 3,693,281 | 9/1972 | Wolf | 446/219 X |
| 4,059,913 | 11/1977 | Garcia | 40/363 X |

*Primary Examiner*—Mickey Yu

*Attorney, Agent, or Firm*—Jay M. Cantor

[57] ABSTRACT

The disclosure relates to a story book wherein the rear cover is of increased thickness so that it can hold the necessary transparencies and optics therein for viewing and wherein predetermined pages of the story book are provided with apertures aligned with transparencies and optics associated therewith so that the viewer can observe the scene being depicted on a transparency by locking through the aperture on the page. The transparency illustrations which are disposed in the book rear cover, in one embodiment, are encased in opaque tubes, each tube being aligned with one of the apertures on the book pages. Each of the tubes includes a magnifying lens on the side of the rear cover closest the apertures on the pages and a transparency of the scene to be depicted between the lens and the portion of the rear cover remote from the apertures. A transparent, translucent or frosted screen can be provided on the side of the transparency remote from the lens to permit the entry of diffused ambient light through the transparency and also to protect the transparency from outer elements.

In a second embodiment of the invention, the fixed transparency is replaced by a film reel rotatable by means of a crank so that a plurality of scenes can be observed through each aperture of the book.

5 Claims, 2 Drawing Sheets

PEEK-IN STORY BOOK

This application is a continuation of application Ser. No. 537,660, filed Sept. 30, 1983, now abandoned.

BACKGROUND OF THE INVENTION

1. Field of the Invention

This invention relates to a children's story book and, more specifically, to a story book wherein pictures of unknown, secret, inaccessible places or the like can be observed by viewing predetermined locations on a story book page.

2. Description of the Prior Art

Story books and especially such books for children typically include illustrations in great number depicting various aspects of the story being read either by or to a child. These pictures are two-dimensional in nature and merely illustrate that portion of the story which is being read. It is desirable to add to the prior art story books for children an additional element which will increase the child's desire to read or have read to him such story books and which will enhance the child's curiosity.

SUMMARY OF THE INVENTION

In accordance with the present invention, the above desired improvement in prior art story books for children is provided wherein, as pages of the book are being read, the child can look beyond the usual illustrations in the book such as, for example, by looking into a window of a normal two-dimensional house and observing a photograph of the interior of the room within the house. The contents of this room are provided on a photographic transparency or the like and can be enlarged by providing appropriate optics between the photographic transparency and the viewer. Briefly, the above is accomplished by providing a normal type story book except that the rear cover is of increased thickness so that it can hold the necessary transparencies and optics therein for viewing and predetermined pages of the story book are provided with apertures aligned with the one or more of the transparencies and optics associated therewith so that the viewer can observe the scene being depicted on a transparency by looking through the aperture on the page as directed. The transparency illustrations which are disposed in the book rear cover are, in one embodiment, encased in opaque tubes, each tube being aligned with one of the apertures on the book pages. Each of the tubes includes a magnifying lens on the side of the rear cover closest the apertures on the pages and a transparency of the scene to be depicted between the lens and the portion of the rear cover remote from the apertures. If desired, a transparent, transluscent or frosted screen can be provided on the side of the transparency remote from the lens to permit the entry of diffused ambient light through the transparency and also to protect the transparency from outer elements. Also, other features may be added such as, for example, a bell within the rear cover which can be rung upon shaking of the book or, the pages themselves can be scented in well known manner to provide a scent of the type expected from the scene being viewed.

In a second embodiment of the invention, the fixed transparency is replaced by a film reel rotatable by means of a crank so that a plurality of scenes can be observed through each aperture of the book.

It can therefore be seen that there is provided a story book of standard type with the addition that interesting scenes can be viewed through the pages via strategically located apertures thereon to enhance the pleasure and curiosity during the reading of the story book.

DESCRIPTION OF THE PREFERRED EMBODIMENT

Figure 1:
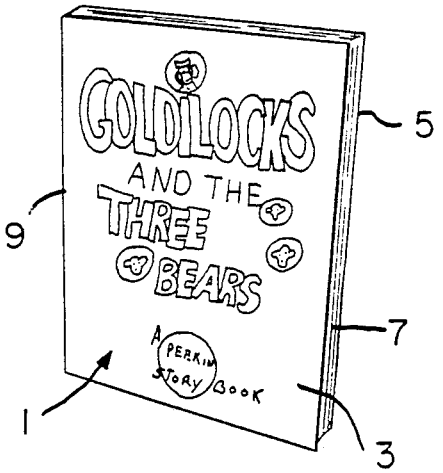
FIG. 1 is a story book in accordance with the present invention.
Figure 2:
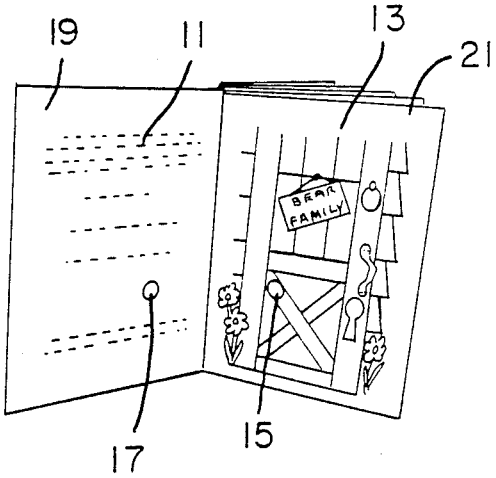
FIG. 2 is a view of an interior pair of pages of the story book showing an aperture therein on the illustration.

Referring first to FIG. 1, there is shown a story book 1 having a front cover 3, a rear cover 5, interior pages 7 and a binding 9. The front cover 3 and binding 9 are the same as in the case of standard books and will not be discussed further. The pages themselves, 19 and 21, as can be seen in FIG. 2, include text 11 and pictures 13. While text and pictures can be provided on both of the facing pages 19 and 21 shown in FIG. 2, the picture 13 will preferably be on a right hand side and include at least one aperture 15 which is aligned with the aperture 17 when the page 19 rests over the page 21. It can be seen that the pages depicted in FIG. 2 will be toward the front end of the book and instructions to view the aperture 15 through the aperture 17 will be provided on a prior page since the aperture 15 can be viewed through the aperture 17 from at least the page prior to the page noted as 19.

Figure 3:
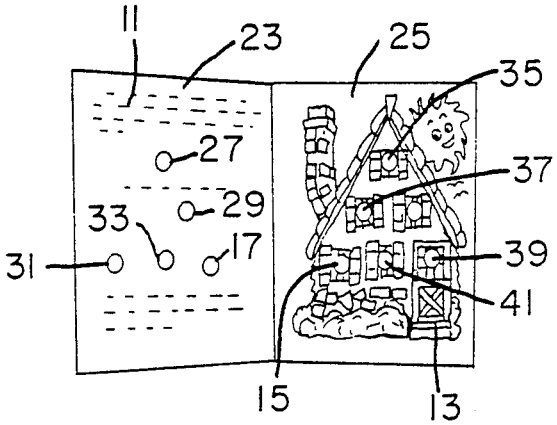
FIG. 3 is a view as in FIG. 2 farther into the book showing plural apertures on the illustration.

Referring now to FIG. 3, there is shown a pair of pages 23 and 25 which are substantially the same as those depicted in FIG. 2 except that they are positioned later in the story book. The aperture 17 can be seen as well as the aperture 15. In addition, there are additional apertures 27, 29, 31 and 33 on page 23 which align with the apertures 35, 37, 39 and 41 respectively on page 25.

Figure 4:
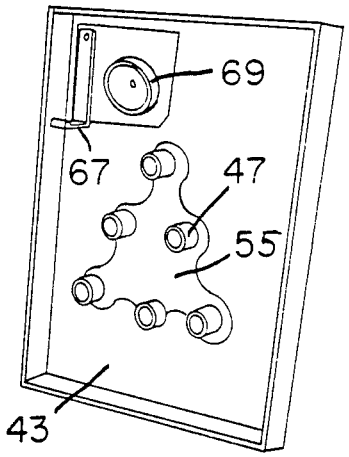
FIG. 4 is an interior view of the portion of the back cover adjacent the interior pages.
Figure 5:
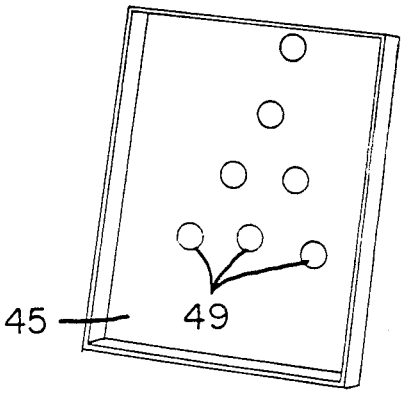
FIG. 5 is an interior view of the portion of the rear cover remote from the interior pages.
Figure 6:
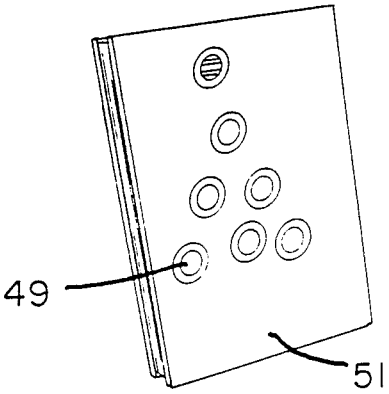
FIG. 6 is a view of the exterior side of the rear cover portion of FIG. 5.

The rear cover 5 is shown in FIGS. 4 through 6. The rear cover includes a pair of cover sections 43 (FIG. 4) and 45 (FIG. 5) which fit into each other to form an enclosure. The back cover portion 43 includes apertures therein aligned with the apertures 15 and 35 through 41 and any other apertures not shown in the drawings and also includes, aligned with these apertures, the optical viewing axes of a plurality of optical viewers 47, each viewer aligned with one of the apertures in the cover 43 and viewable through the apertures 17 and 27 through 33. The cover portion 45 includes apertures 49 which align with the viewing members 47 and also are aligned with the apertures 15 and 35 through 41. The rear surface of the back portion 45 is shown in FIG. 6 and includes a surface 51 which resembles the rear cover of any story book except for the apertures 49 extending therethrough to provide light to the viewing elements 47. The viewing elements 47 can be individually positioned and secured to the back cover portion 43 or can be molded as a single unit 53 as shown in FIG. 4.

Figure 7:
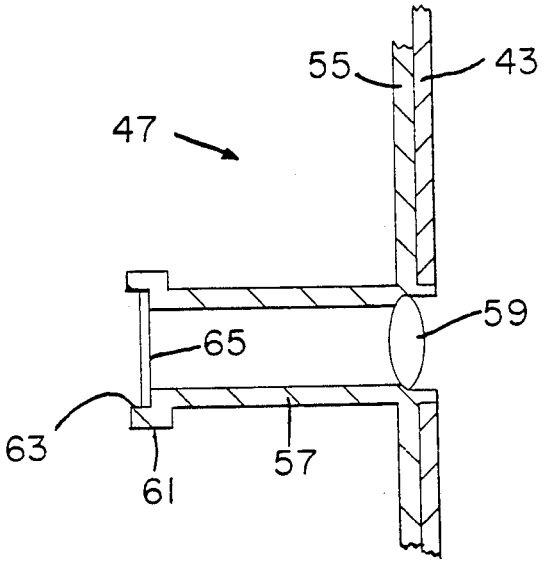
FIG. 7 is a view in cross section of the viewing tube in accordance with the present invention.

Referring now to FIG. 7, there is shown one of the optical viewing elements 47 in accordance with the subject invention. An optical element of this type is described in my U.S. Pat. No. 3,693,281 for Peek In Model Kit. There is shown the rear cover portion 43 to which is secured a holder portion 55 of the viewing tube. A tube portion 57 is secured to the holder portion 55 and a magnifying lens 59 is secured at the interior portion of the tube 57. The tube 57 includes a flange portion 61 having a cut-out region 63 which supports a transparency 65 such as a photographic slide having the scene to be depicted thereon. The transparency 65 is secured to the tube 57 in the cut-out region 63. If desired, a translucent, transparent or frosted screen can be provided on the side of the transparency 65 remote from the lens 59 to provide protection to the transparency from external elements. As can be seen in FIG. 4, a plurality of viewing members 47 as shown in FIG. 7 are provided, one viewing member associated aligned with each of the apertures 17 and 27 through 33, the lens 59 being positioned, for example, at the aperture 15. The optical viewing axes of the viewing members 47 are along the axes of the tubes 57.

It can be seen that, starting from the front of the book, anywhere from none to all of the viewers are accessible therethrough, depending upon the apertures therein. However, once a view is to be made accessible to viewing through a particular page, all subsequent pages as well must have an aperture aligned therewith.

Other desirable features can be provided within the story book. For example, as shown in FIG. 4, a bell is provided whereby, upon shaking of the story book, the clapper 67 will strike the bell 69 to provide a ringing noise.

Figure 8:
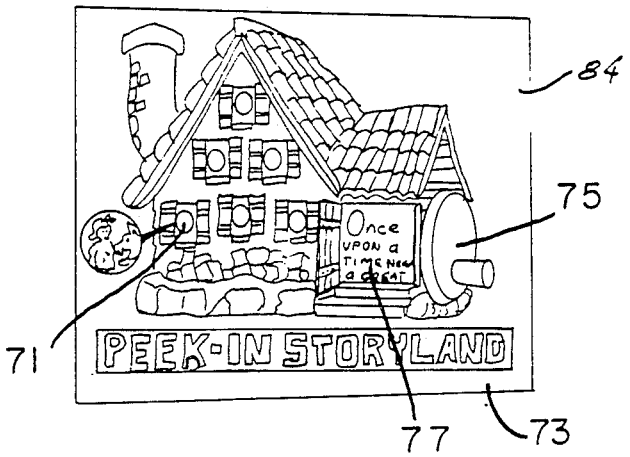
FIG. 8 is an external view of a second embodiment of the story book in accordance with the present invention.

Referring now to FIG. 8, there is shown a second embodiment of a story book in accordance with the present invention. In this embodiment, one or more apertures 71 is provided in the front cover 73 of the story book. An optical viewer similar to that shown in FIG. 7 is aligned with each of the apertures 71, however, the optical viewer is altered so that the transparency 65 of FIG. 7 is replaced by a plurality of connected moveable transparencies on a reel which are moved upon rotation of the crank 75. In this way, the story is depicted by pictures rather than in printed manner. As an alternative, the embodiment of FIG. 8 can be provided in conjunction with a story book as depicted in FIGS. 1 through 6 to provide an action scene rather than a still scene when viewing a particular aperture to depict a particular portion of the story being read.

As a further embodiment, referring to FIG. 8, the crank 75 can be secured to a scroll containing the story text. The story text would then be viewed upon rotation of the crank 75 either through one of the apertures 71 or in the region 77. In either case, the other apertures 71 would contain fixed transparencies therein.

Though the invention has been described with respect to specific preferred embodiments thereof, many variations and modifications will immediately become apparent to those skilled in the art. It is therefore the intention that the appended claims be interpreted as broadly as possible in view of the prior art to include all such variations and modifications.

What is claimed is:

1. A book which comprises, in combination:

(a) a front cover, (b) a back cover, (c) a plurality of pages intermediate said front cover and said back cover, (d) securing means for securing together said front cover, said back cover and said plurality of pages, (e) optical viewer means having a viewing axis along a line normal to the plane of said front cover and said back cover when the book is in a closed position, wherein said optical viewer means comprises an opaque tube, a transparency at the end of said tube remote from said pages and a magnifying lens disposed at the other end of said tube, and (f) means for securing said optical viewer means to said back cover, (g) at least one of said pages and said back cover having an aperture aligned with said viewing axis.

2. A book as set forth in claim 1 which comprises plural optical viewers disposed on said back cover, each of said viewers having a different viewing axis normal to the planes of said front cover and said back cover when the book is in a closed position.

3. A book which comprises, in combination:

(a) a front cover, (b) a back cover, (c) a plurality of pages intermediate said front cover and said back cover, (d) securing means for securing together said front cover, said back cover and said plurality of pages, (e) optical viewer means having a viewing axis along a line normal to the plane of said front cover and said back cover when the book is in a closed position, wherein said optical viewer means comprises an opaque tube, a transparency at the end of said tube remote from said pages and a magnifying lens disposed at the other end of said tube, and (f) means for securing said optical viewer means to said back cover, (g) at least one of said pages and said back cover having an aperture aligned with said viewing axis, (h) wherein said back cover comprises a front surface portion and a rear surface portion separated from said front surface portion, said surfaces having apertures along said viewing axis, said optical viewer means being disposed between said surfaces.

4. A book as set forth in claim 3 which comprises a plural optical viewers disposed in said back cover, each of said viewers having a different viewing axis normal to the planes of said front cover and said back cover when the book is in a closed position.

5. A book as set forth in claim 3 wherein the one of said plurality of pages closest to said back cover comprises an aperture therein aligned with the viewing axis of said viewer means and wherein the remainder of said plurality of pages has progressively in the direction of said front cover the same number of apertures or less apertures aligned with said viewing axes than the prior page.

* * * * *